United States Patent [19]

Simanjuntak

[11] Patent Number: 4,733,994

[45] Date of Patent: Mar. 29, 1988

[54] DRIVEN PILE WITH TRANSVERSE BROADENING IN SITU

[76] Inventor: Johan H. Simanjuntak, Jalan Tanah Abang II/23, Jakarta, Indonesia

[21] Appl. No.: 934,620

[22] Filed: Nov. 24, 1986

Related U.S. Application Data

[63] Continuation of Ser. No. 698,103, Feb. 4, 1985, abandoned.

[30] Foreign Application Priority Data

Apr. 6, 1984 [ID] Indonesia ..... 10,005

[51] Int. Cl.[4] ..... E02D 5/74

[52] U.S. Cl. ..... 405/244; 405/232

[58] Field of Search ..... 405/244, 196, 232; 52/158, 159, 160, 162, 155, 156; 179/5, 9, 7

[56] References Cited

U.S. PATENT DOCUMENTS

| | | | |
|---|---|---|---|
| 1,026,402 | 5/1912 | Marshall et al. | 52/159 |
| 1,762,341 | 6/1930 | McPherson | 405/244 X |
| 2,198,964 | 4/1940 | Goodyear | 403/12 |
| 2,468,729 | 5/1949 | Black | 405/244 X |
| 2,812,200 | 11/1957 | Yeargan | 403/12 |
| 2,878,649 | 3/1959 | Jacobs | 175/9 X |
| 2,881,591 | 4/1959 | Reeve | 405/224 |
| 3,628,337 | 12/1971 | Stepanich | 405/253 |
| 4,091,882 | 5/1978 | Hashimoto | 52/160 X |

FOREIGN PATENT DOCUMENTS

| | | | |
|---|---|---|---|
| 97525 | 1/1984 | European Pat. Off. | 405/244 |
| 2405238 | 8/1975 | Fed. Rep. of Germany | 52/159 |
| 0142925 | 11/1981 | Japan | 405/244 |
| 761663 | 9/1980 | U.S.S.R. | 405/244 |
| 815125 | 3/1981 | U.S.S.R. | 405/244 |

*Primary Examiner*—Dennis L. Taylor

*Attorney, Agent, or Firm*—Christie, Parker & Hale

[57] ABSTRACT

A pile element is disclosed for supporting a structure after being driven into a soil stratum. The pile element includes a pile body defining an exterior surface of the pile. At least one plate is adapted to be retained substantially within the pile body during driving of the pile. The at least one plate is caused to protrude sideways from the pile body upon completion of driving of the pile.

14 Claims, 8 Drawing Figures

Fig. 5
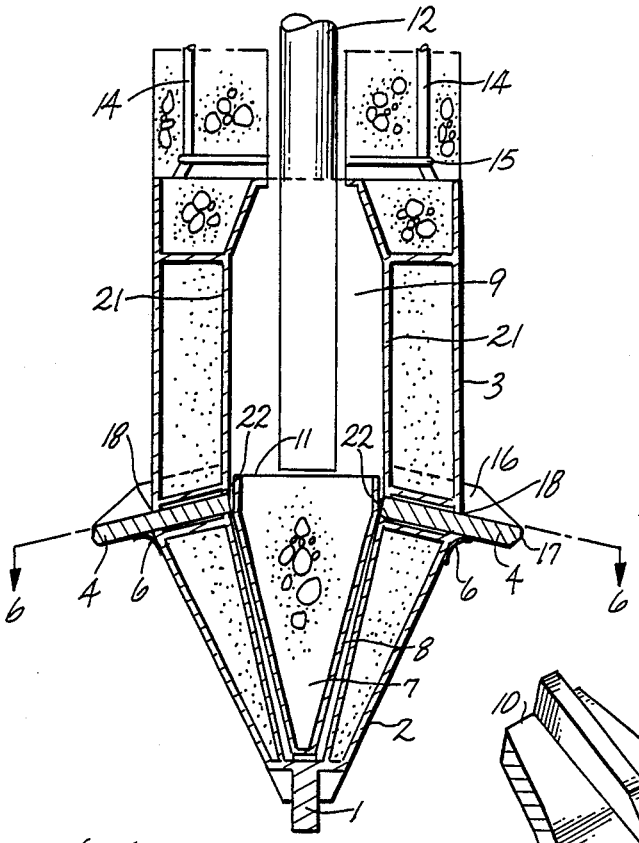
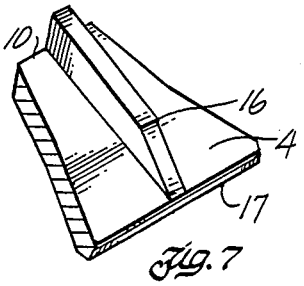
Fig. 7
Fig. 6
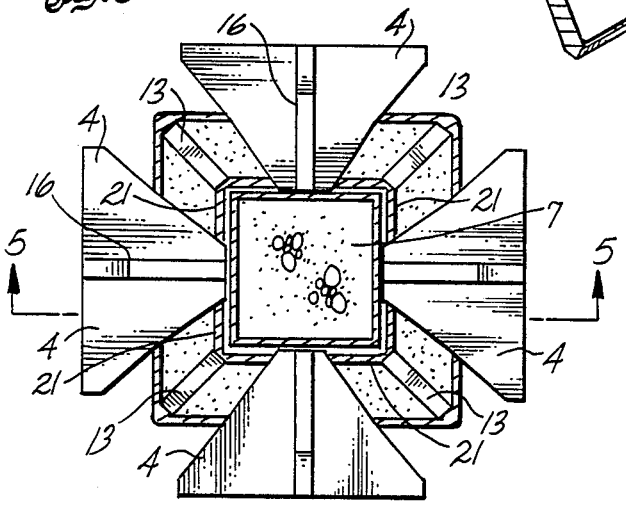

DRIVEN PILE WITH TRANSVERSE BROADENING IN SITU

CROSS-REFERENCE TO RELATED APPLICATIONS

This is a continuation of application Ser. No. 698,103 filed Feb. 4, 1985 now abandoned.

BACKGROUND OF THE INVENTION

1. Field of the Invention

This invention relates to piles, which may be square or round in cross-section, made of pre-cast concrete or steel.

2. Description of Related Art

It is well understood that the overall bearing capacity of a pile is determined by two factors viz, the bearing capacity of the soil in the area in which the pile is to be driven and the structural strength of the pile itself. Generally, of these two limitations, the bearing capacity of soil is a decisive factor. The problem now is how to increase the total soil bearing capacity relative to the pile or to improve the interactions between the soil layers and the pile body to such an extent that the total bearing capacity becomes higher. The bearing capacity of the soil relative to the pile depends on two-forces; these are the friction forces acting against the body of the pile and the end bearing forces.

The broader the pile foot, the greater the end resistance of the pile itself. However, a pre-cast concrete pile with an enlarged foot cannot be easily driven, due to the greater resistance in penetrating the soil layer.

SUMMARY OF THE INVENTION

According to the present invention, there is provided a pile formed of pre-cast concrete or of steel or other suitable metal. The pile is provided at least at one part along its length with an assembly of substantially transversely extending steel or other suitable metal plates. During driving of the pile, the plates are located wholly within the pile but can be caused to protrude from the sides of the pile upon: completion of driving of the pile to increase or improve the bearing capacity of the pile. When the pile tip reaches the firm soil strata, driving is discontinued. The cross-sectional area of the pile foot or toe, or another part of the pile, is then increased, preferably, horizontally, in such a way that the pile will have a wider contact base, which increases the soil bearing capacity of the pile.

When this invention is applied to the toe of a pile, it has three functions, each of which positively complement one another to increase the quality and performance of the pile. Firstly, the invention reinforces the pile tip for penetrating hard layers. Secondly, pre-cast concrete pile tips produced manually on site in wooden molds are often asymmetric in form, and the resulting pile has a tendency to deviate from its original path during driving. Using the present invention, the pile can be driven in a straight direction without deviation. A steel pile toe manufactured according to the present invention with precision in a standard form substantially eliminates any deviation.

The third and major function of the toe of the present invention is to provide a broader base for the pile, which increases the bearing capacity of the pile as a whole.

According to an embodiment of the invention, steel discs or plates are located inside the lower part of the pile body, preferably exactly at the line between the vertical surface of the pile and the tapered surface of the pile tip. However, the steel plates can be placed either at the lower part of the pile or anywhere along the pile body.

The toe is preferably made of steel. The steel plates are preferably located inside and placed horizontally within the toe. The steel plates can be pushed out through apertures and penetrate into the soil horizontally after driving of the pile is complete.

The plates are pushed out immediately after driving is completed, when the pile tip has reached and arrived at the firm soil layer. The plates are pushed out from the center of the toe by friction forces produced at the inner side of the plates from the downward motion of a conical or pyramid-shaped actuator member in the center of the pile. However, a part of the steel plates remains inside the apertures.

During assembly of the pile and toe, and during transportation and driving of the pile, the steel plates should always be retained wholly inside the body. Small steel bars placed across the outer ends of the apertures prevent the plates from sliding out. One end of each bar is welded to the outer surface of the pile foot.

BRIEF DESCRIPTION OF THE DRAWINGS

An embodiment of the invention will now be described, by way of an example, with reference to the accompanying drawings, in which:

FIG. 5 is a longitudinal section through the toe of the pile of FIG. 2 with the plates moved outwardly, the section being taken along the line V—V of FIG. 6;

FIG. 6 is a transverse section through the toe of the pile of FIG. 2 taken along the line VI—VI of FIG. 5;

FIG. 7 is a perspective view of a steel plate for use in the embodiments of FIGS. 1–6.

DETAILED DESCRIPTION OF THE PREFERRED EMBODIMENT

Figure 1:
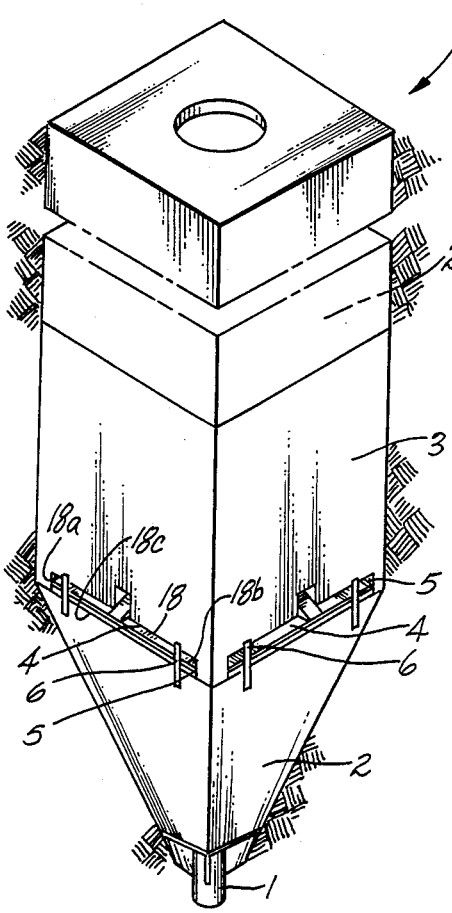
FIG. 1 is a perspective view of a pile according to the present invention in a form to be used during driving with plates in a retracted position.
Figure 2:
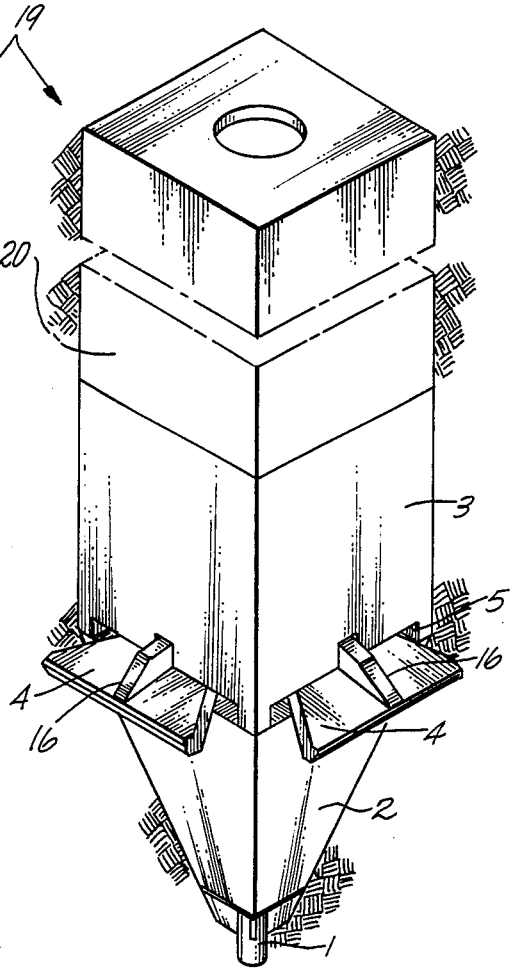
FIG. 2 is a perspective view of the pile of FIG. 1 with the plates moved outwardly.

As shown in the drawings, FIG. 1 and FIG. 2, a column in the form of a pile 19 has a hollow rectangular body portion 20 formed of pre-cast concrete and defining the pile for supporting a building or other structure. The pile may also be formed of steel and may have a circular cross-section or any other suitable cross-sectional shape. Provided at the bottom end of the pile is a toe 3 formed of steel, the upper part of which has a cross-section corresponding to that of the body portion 20 and the lower part 2 of which has the shape of an inverted pyramid for guiding the pile into the soil. In the case where the pile is circular in cross-section, the lower part 2 preferably has the shape of an inverted cone. Provided at the apex of the lower part 2 is a tip 1 for penetrating the soil.

Apertures in the form of slots 5 are provided, preferably at the transition between the upper part and the lower part 2, for positioning and guiding generally transversely oriented steel discs or, as shown in FIG. 7, trapezoidal plates 4, to be described below. The slots have edges 18, 18*a*, 18*b*, and 18*c* formed in the wall of the body portion defining each slot. The slots extend in a direction substantially perpendicular to the direction in which the pile is to be driven. During assembly, transportation and driving of the pile, the discs are retained wholly within the toe 3 by retainer members 6. The retainer members extend generally upwardly across the respective outer ends of the slots 5. The members 6 comprise steel bars which at their bottom end are welded to the lower part 2 of the toe and extend upwardly toward the upper part of the toe. During downward movement of the pile, these steel plates 6 are pressed by the surrounding soil which keeps the steel disc in position inside the shoe.

Figure 3:
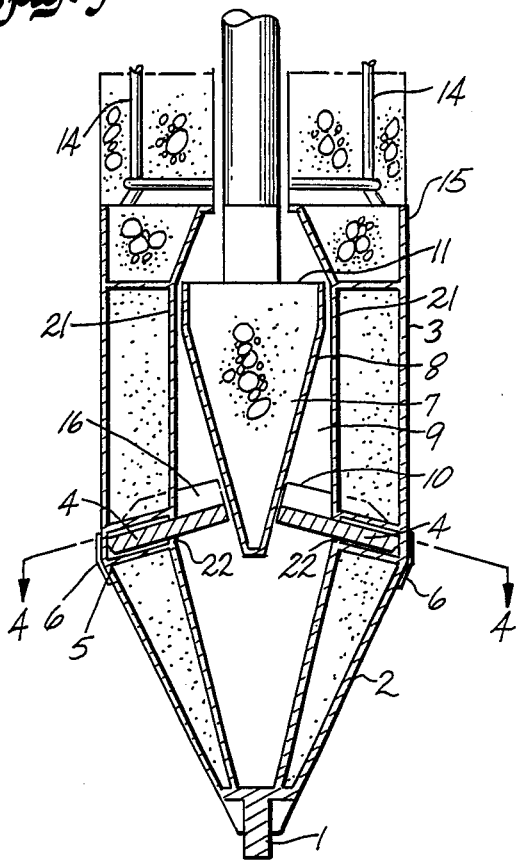
FIG. 3 is a longitudinal section through the toe of the pile of FIG. 1 with the plates retracted, the section being taken along the line III—III of FIG. 4.
Figure 4:
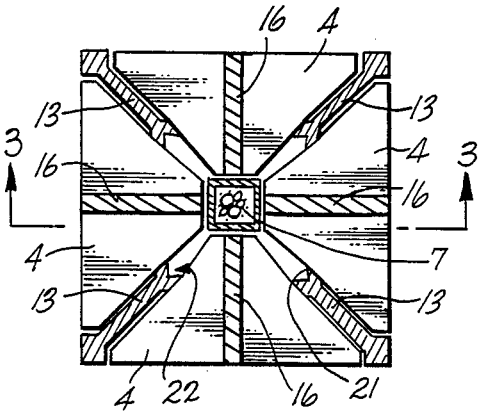
FIG. 4 is a transverse section through the toe of the pile of FIG. 1 taken along the line IV—IV of FIG. 3.

The pile toe 3 is anchored at the body portion 20 of the pile by steel anchors 14 (FIG. 3) which are welded to a steel plate 15 of the pile toe 3. The pile toe 3 is provided with reinforcing ribs 13 (FIG. 4).

The reinforcing ribs 13 provide support between the outer structure of pile toe 3 and an internal frame 21 of the pile toe. The space between the outer structure and the internal frame may be filled with concrete. The internal frame guides and retains an actuator member 7 for actuating the plates outwardly, to be described below. The transverse cross-sectional shape of the internal frame preferably follows, on a longitudinal axis, the transverse cross-sectional shape of the outer structure of pile toe 3. Generally horizontal slots 22 for accommodating the plates 4 are provided, preferably at the transition between upper and lower parts of the internal frame. A vertical slot is formed midway in each respective slot 22 and substantially perpendicular thereto extending upwardly from the slot 22.

The plate 4 preferably is generally trapezoidal-shaped or dove tailed with the long parallel side or outer edge 17 being upwardly tapered so that a bevel is provided on the top edge (FIG. 7). The trapezoidally-shaped plate is for use preferably with a pyramid-shaped pile toe. The upper surface of each plate (FIG. 7) is provided with an upwardly extending reinforcing rib 16 whose inner end 10 contacts the surface of actuator member 7. As the rib 16 approaches the outer edge 17 of the plate, the upper surface of the rib is beveled downwardly to meet the outer edge 17.

Figure 8:
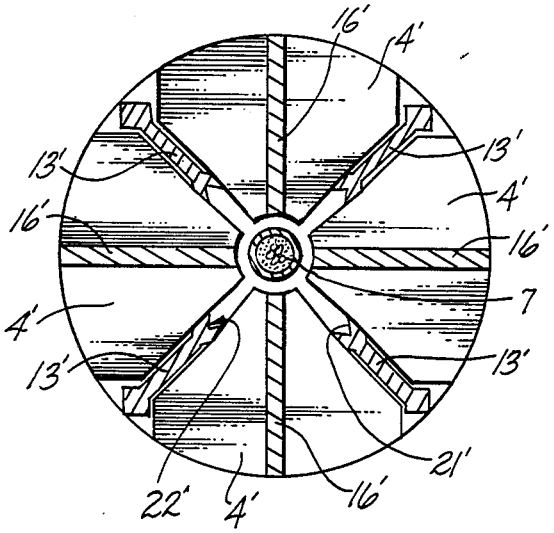
FIG. 8 is a transverse section through the toe of a pile, similar to that of FIG. 4, for an alternate embodiment where the toe of the pile and the actuator all have a conical outer shape.

An actuator member 7 (FIG. 3) is located within the toe 3, interior to the internal frame 21, and is formed from a steel plate 8 and whose interior is filled with concrete. The member 7 is in the form of an inverted pyramid and the sides of the member 7 contact the inner ends of the plates 4. The pyramid-shaped actuator member is provided in the center of the toe, installed with the apex facing downwardly. The actuator member operates as a piston pressed down by an impact mandrel driven from the top of the pile. When the member is driven down by the mandrel, the member forces the plates to move horizontally along the apertures and to penetrate into the soil, thereby increasing the bearing capacity of the pile.

Where the toe is conically shaped, the actuator member is also preferably conically shaped. The pile toe with a conical configuration is shown in FIG. 8, which is a view of a pile toe similar to that of FIG. 4. The shapes of the elements of FIG. 4 have been changed to conform to a pile toe of circular cross-section and are identified with the same reference numerals as used in FIG. 4 but with primes added. The function of the elements is substantially the same as that described with respect to the pile toe of FIG. 4.

The application of the invention will now be described. The pile is driven into the ground until it has penetrated into the firm soil strata. The driving of the pile is terminated and the mandrel is inserted into the pile from its upper end. The mandrel contacts the upper end 11 of the member 7 and is then driven downwardly against the actuator member from the upper end of the mandrel to move the member 7 downwardly. The member 7 acts on the plates 4 to cause them to move outwardly through the apertures 5. During the initial movement of the plates 4, the steel retaining bars 6 are deformed outwardly. The plates 4 penetrate into the strata surrounding the toe 3 and due to the tapered surface of each plate 4 is in contact with the upper edge 18 of the apertures 5. The plates 4 remain within the apertures 5 after being pushed outwardly by the member 7. The inner part 9 of the toe 3 is hollow to allow movement of the mandrel. When the plates 4 have been pushed outwardly, the mandrel is removed from the pile and the interior of the body portion of the pile and the inner part 9 of the toe 3 are filled with concrete to strengthen the pile structure. This filling is carried out by passing concrete into the pile from its upper end.

The plates 4, when pushed outwardly, increase the contact area of the pile within the strata into which it has been driven. Thus, the bearing capacity of the pile is increased.

The number of plates 4 is preferably a minimum of two and should be symmetrically disposed.

It will be appreciated that the plates 4 instead of being located within the toe 3 may be located at any other desired location or locations along the pile.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. A pile assembly for supporting a structure after the pile assembly is driven into a soil stratum, the assembly comprising:

a reinforced concrete pile element having a rectangular cross section and comprising an end and an inner wall defining a passageway for a mandrel;

a pyramidally-shaped pile toe mounted to the end of the pile element, the toe comprising a metal housing with a rectangular upper portion and four interior walls, the walls being joined to form a tapered bottom portion, each wall defining an aperture between the upper and lower portions;

a movable actuator substantially enclosed by the metal housing and having a bottom portion and a pyramidal cross sectional area greater than the cross sectional area of the passageway; and a trapezoidally-shaped plate corresponding to each of said apertures, each plate having a short side adjacent the actuator and a long side adjacent the corresponding aperture;

the actuator having a first position in the housing so that each of the trapezoidally-shaped plates may be positioned interior to the metal housing and having a second position such that the bottom portion of the actuator is adjacent the interior walls of the bottom portion and bear against the short side of each of the trapezoidally-shaped plates and thereby extend each plate at least partially from the respective aperture to a point external to the metal housing.

2. The pile assembly as claimed in claim 1 further comprising at least one deformable metal bar extending across each aperture and wherein each bar is fixed to the metal housing adjacent the bottom of the corresponding aperture.

3. The pile assembly as claimed in claim 1 wherein each deformable bar comprises a width and the corresponding aperture comprises a height across the corresponding aperture, and wherein the width is smaller than the height.

4. An elongated pile assembly having an interior and exterior portions, for supporting a structure after the pile assembly is driven into a soil stratum, the assembly comprising:

a passageway extending substantially along the elongation of and in the interior portion of the pile assembly;

a plurality of slots extending from the passageway to the exterior portion of the pile assembly;

a plurality of trapezoidally-shaped plates, one plate in each slot, each plate, when in a retracted condition, having a short side exposed in the passageway and a longer side displaced from the passageway toward the exterior portion of the pile assembly; and a movable actuator positioned within the passageway for applying a force to the short side of and for actuating each of the trapezoidally-shaped plates in a direction away from the passageway to an exposed position beyond the exterior portion of the pile assembly.

5. The pile assembly in claim 4 wherein each plate has at least one reinforcement rib elongated substantially along a line and in a direction between the short side to the longer side of the plate.

6. The plate in claim 5 wherein the reinforcement rib has a tapered edge toward the longer side for reducing drag during actuation of the plate into a soil stratum.

7. The pile assembly in claim 4 wherein each of the slots are trapezoidally-shaped.

8. The pile assembly in claim 4 wherein each slot is at an acute angle to the elongation of the pile assembly.

9. The pile assembly in claim 4 wherein the movable actuator has a first position in the passageway so that the trapezoidally-shaped plates may be extended substantially into the passageway, and thereby not extend beyond the exterior portion of the pile assembly, and the movable actuator when actuated bears against the short side of each plate extending each plate at least partially from the respective slot to a position external to the pile assembly.

10. The pile assembly in claim 4 further comprising a movable mandrel for urging the actuator toward the bottom of the pile assembly.

11. The pile assembly in claim 10 wherein the mandrel is disconnected from the pile assembly.

12. The pile assembly in claim 4 wherein the exterior portion has substantially flat and parallel sides and a slot is associated with each side for passing at least one of the plates.

13. The pile assembly in claim 4 further comprising a reinforced concrete pile element having a retangular cross section and an end with an inner wall have thereon a passageway adapted to pass and guide the movable mandrel.

14. The pile assembly in claim 4 further comprising a tapered bottom portion defined by exterior sides which converge to a sharp point.

* * * * *

UNITED STATES PATENT AND TRADEMARK OFFICE

CERTIFICATE OF CORRECTION

PATENT NO. : 4,733,994

DATED : March 29, 1988

INVENTOR(S) : Johan H. Simanjuntak

It is certified that error appears in the above-identified patent and that said Letters Patent is hereby corrected as shown below:

In the Specification

| | |
|---|---|
| Column 1, Line 26 | "two-forces" should read -- two forces |
| Column 1, Line 42 | delete ":" |
| Column 4, Line 20 | after "and" insert — , -- |
| Column 4, Line 21 | After "4" insert -- , -- |
| Column 4, Line 65 (Claim 1, Line 17) | after "each" insert -- one -- |
| Column 6, Line 33 (Claim 13, Line 2) | "retangular" should read -- rectangular -- |

Signed and Sealed this

Fifteenth Day of November, 1988

*Attest:*

*Attesting Officer*

DONALD J. QUIGG

*Commissioner of Patents and Trademarks*